United States Patent [19]

Wendl et al.

[11] Patent Number: 4,479,305

[45] Date of Patent: Oct. 30, 1984

[54] MEASURING BRIDGE

[75] Inventors: Daniel P. Wendl, Waukesha; Paul J. Lukezich, Greenfield, both of Wis.

[73] Assignee: Applied Power Inc., Milwaukee, Wis.

[21] Appl. No.: 357,581

[22] Filed: Mar. 12, 1982

[51] Int. Cl.[3] ..... G01B 5/14

[52] U.S. Cl. ..... 33/180 AT; 33/288

[58] Field of Search ..... 33/180 AT, 181 AT, 174 R, 33/174 L, 174 P, 174 PA, 174 G, 288

[56] References Cited

U.S. PATENT DOCUMENTS

| | | | |
|---|---|---|---|
| 2,607,990 | 8/1952 | Payamps | 33/27 C |
| 4,165,567 | 8/1979 | Olsson | 33/180 AT X |
| 4,174,623 | 11/1979 | LeGrand et al. | 33/180 AT X |
| 4,319,402 | 3/1982 | Martin | 33/181 AT X |
| 4,329,784 | 5/1982 | Bjork | 33/180 AT |
| 4,342,154 | 8/1982 | LeGrand | 33/180 AT |

FOREIGN PATENT DOCUMENTS

| | | | |
|---|---|---|---|
| 1361170 | 7/1974 | United Kingdom | 72/705 |
| 2019573 | 10/1979 | United Kingdom | 33/181 AT |

*Primary Examiner*—Harry N. Haroian

*Attorney, Agent, or Firm*—Fred Wiviott

[57] ABSTRACT

A measuring bridge for determining the degree of motor vehicle damages includes a main frame and a plurality of vehicle supports adjustable three dimensionally relative to the main frame. A first elongate guage is pivotally connected to a magnet coupler securable to the frame and having a pair of longitudinally and vertically adjustable measuring elements for the successive location of a plurality of datum points on the bottom of the vehicle. In addition, a plurality of tram gauges are supported on the main frame above the vehicle and are adjustable three dimensionally for locating datum points located on upper portions of the vehicle.

26 Claims, 11 Drawing Figures

MEASURING BRIDGE

BACKGROUND OF THE INVENTION

This invention relates to an improved measuring bridge employed in the repair of damaged motor vehicles.

Before a damaged motor vehicle can be repaired, it is necessary to determine the extent to which the location of various datum points on the vehicle deviates from manufacturer's specifications. Repair is then achieved by reforming damaged portions of the vehicle until all datum points have been returned to the proper relative positions. Proper repair of body damage is particularly important in vehicles which do not have a frame since accurate body alignment is essential for proper vehicle suspension and steering.

Systems for measuring the alignment of vehicle bodies are commonly called measuring bridges. Such assemblies generally include a fixed frame having a plurality of support fixtures upon which the vehicle is supported by engaging key datum points. The location of such key datum points is different for most automobile models and particularly those employing the uni-body construction. As a result, most prior art measuring bridges require a different set of support and measuring fixtures for almost every automobile model and body style. This substantially increases the cost of such systems, particularly as the result of a proliferation of new models which require the continued aquisition of additional fixtures.

A further disadvantage of prior art measuring bridges was that they required partial disassembly of the motor vehicle before measurements could commence. For example, some measuring bridges required the removal of the vessel suspension and/or the engine in order to determine the location of key points such as the McPherson strut anchoring points. This was a costly and time consuming operation.

Costs were also increased in some prior art systems as a result of the manner in which measurements were made. For example, it was a common practice to employ a tape for determining the relative distance between certain vehicle data points. This required the operator to have an assistant for holding one end of the tape.

Another shortcoming with prior art measuring bridges is that many determine the position of vehicle datum points relative to a fixed location on the bridge itself. However, published manufacturer's specifications normally provide information regarding the distance between various locations on the vehicle. As a result, many prior art measuring bridges require special charts for converting manufacturer's published specifications to bridge measurements.

SUMMARY OF THE INVENTION

It is an object of the invention to provide a new and improved measuring bridge.

A further object of the invention is to provide a measuring bridge which does not require a different set of fixtures for each motor vehicle model and body style.

Another object of the invention is to provide a measuring bridge in which vehicle measurements can be accomplished without substantial vehicle disassembly.

A still further object of the invention is to provide a measuring bridge which permits measurements to be made by a single operator.

Yet another object of the invention is to provide a measuring bridge which is readily adaptable to use with published manufacturer's specifications and without conversion.

These and other objects and advantages of the present invention will become more apparent from the detailed description of the preferred embodiment of the invention taken with the accompanying drawings.

In general terms, the invention comprises a measuring bridge having a main frame, a plurality of support assemblies selectively securable at various discrete locations to the main frame and which are additionally adjustable three-dimensionally relative to the main frame for precisely locating a plurality of support points below the vehicle. A first portable guage is releasable securable to the main frame in an infinite number of relative positions and has fixed and movable measuring elements so that the relative location of any two points beneath the vehicle can be precisely determined. An overhead guage is securable to the frame in a plurality of discreet relative positions and includes guage means extending above the vehicle and having at least one guage assembly mounted thereon and adjustable three-dimensionally for accurately determining the location of a datum point on the upper portion of the vehicle.

DETAILED DESCRIPTION OF THE PREFERRED EMBODIMENT

Figure 1:
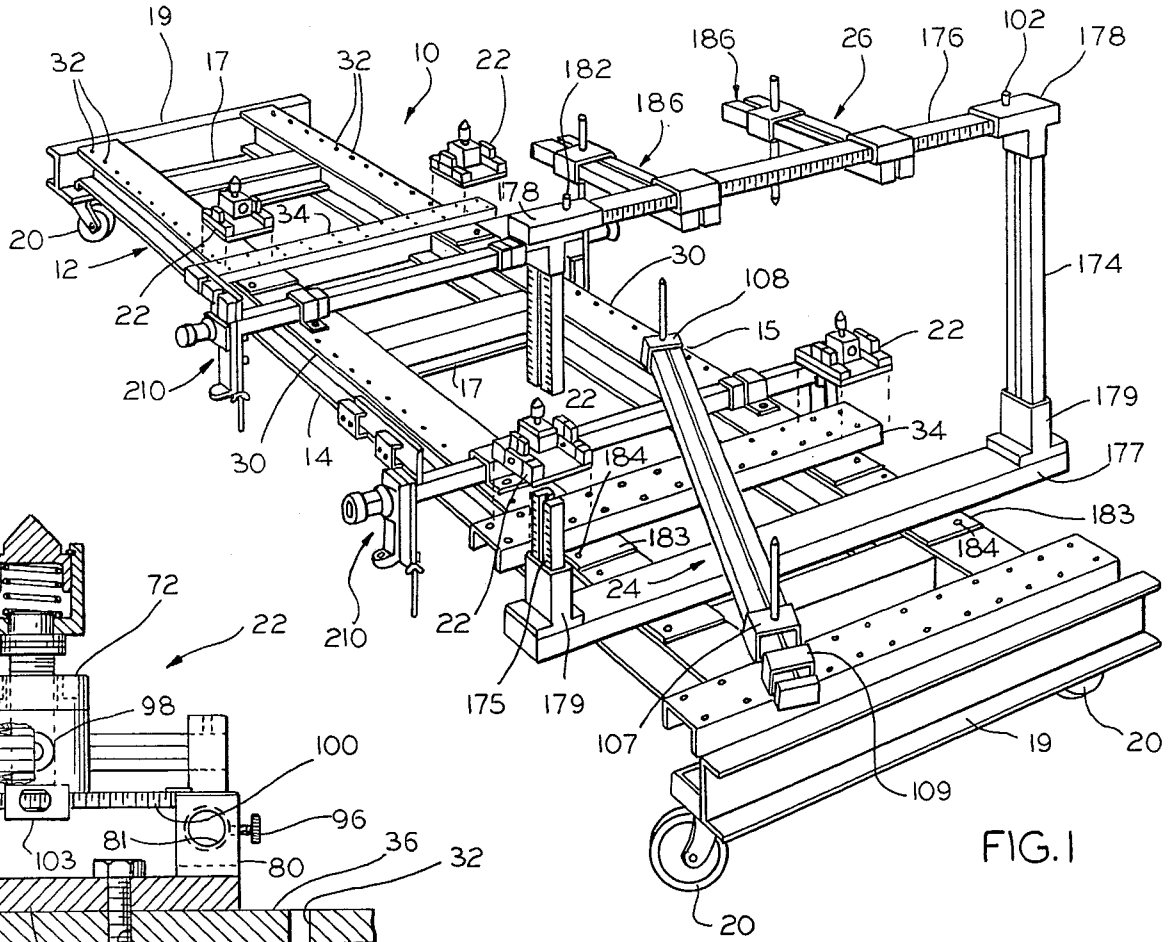
FIG. 1 is a perspective view of a preferred embodiment of the invention.

The measuring bridge 10 is illustrated in FIG. 1 to include a main frame 12 having a pair of parallel, spaced apart main beams 14 and 15 and a plurality of cross beams 17 extending between the main beams and suitably secured thereto in any suitable manner, such as by welding. In addition, an end piece 19 is suitably affixed at each end of the frame 12 and extends between the main beams 14 and 15. Suitable rollers or casters 20 may be affixed below the opposite ends of each piece 19 to rollably support the measuring bridge 10. While the main beams 14 and 15 are shown in FIG. 1 to comprise I-beam members, it will be appreciated by those skilled in the art that any suitable structural shape may be employed.

The vehicle being repaired is supported on the frame 12 by means of a plurality of support assemblies 22 which may be mounted on the main frame 12 in a plurality of predetermined discreet locations depending upon the specifications of the particular vehicle. In particular, the assemblies 22 are constructed and arranged to be engaged for support by datum points on the underside of the vehicle which, if undamaged, will have a predetermined spacial relation. This locates at least some datum points on the vehicle relative to frame 12. The deviation, if any, of other datum points on the vehicle from the manufacturer's specifications can be determined by a portable gauge 24 located on frame 12 below the vehicle for locating points on the underside of the vehicle and on overhead guage assembly 26 for locating such points on the upper portions of the vehicle.

Figure 2:
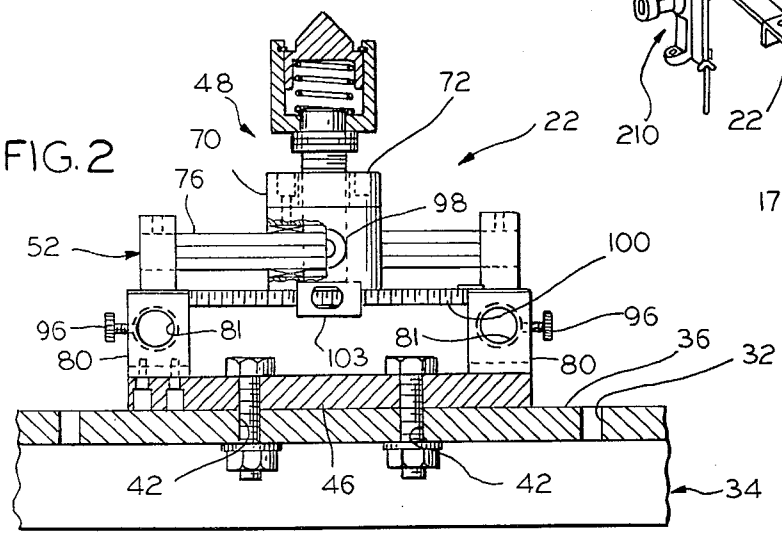
FIG. 2 is a side view, with parts broken away, of that portion of the measuring bridge shown in FIG. 1 upon which the motor vehicle is supported.
Figure 3:
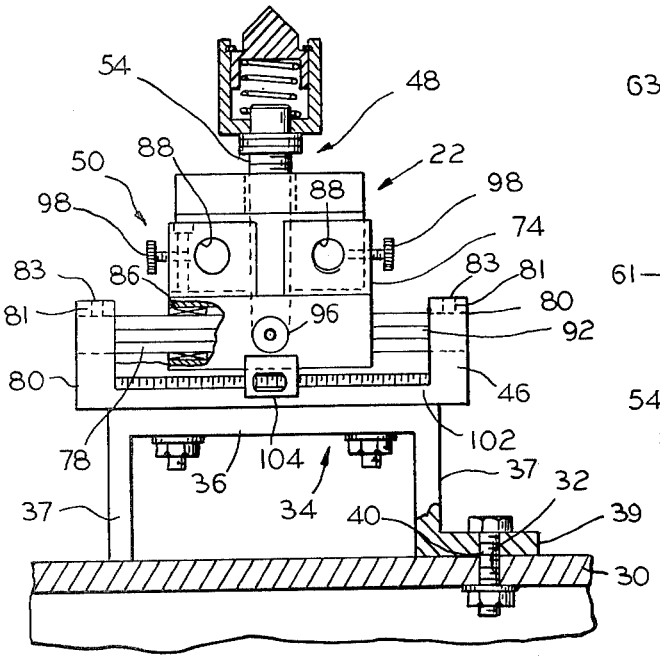
FIG. 3 is an end view, with parts broken away, of the support portion shown in FIG. 2.
Figure 5:
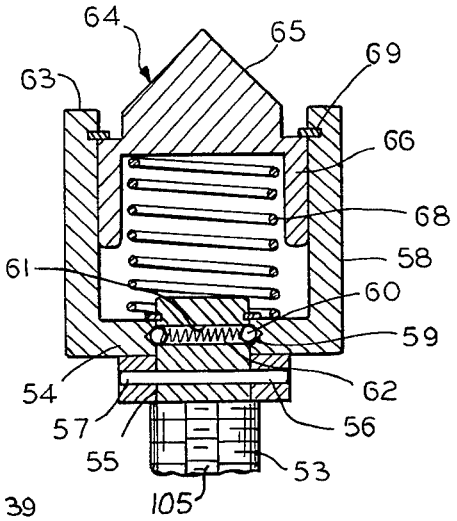
FIG. 5 is a sectional view of one element of the support portion shown in FIGS. 2–4.
Figure 4:
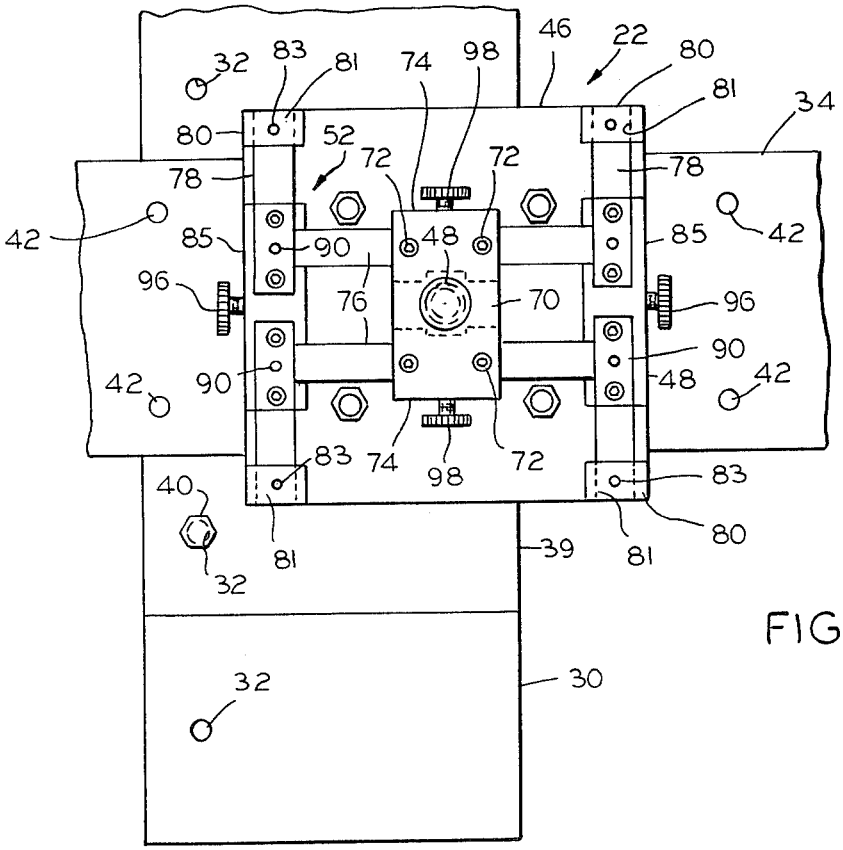
FIG. 4 is a top plan view of the support portions shown in FIGS. 3 and 4.

The manner in which the support assemblies 22 are mounted on the main frame 12 is shown in FIGS. 2, 3 and 4. More particularly, the upper flanges 30 of main beams 14 and 15 are co-planar and each has a row of precisely spaced apart apertures 32 extending longitudinally from one end to the other. This established the primary longitudinal reference locations for the system. The flanges support a pair of spaced apart, transversely extending support members 34, each of which has an inverted U-shape in transverse cross-section and is defined by a center web portion 36 and a pair of downwardly extending side portions 37 whose lower edges rest atop the main beam flange 30. In addition, flange 39 extends laterally at each end of the member 34 and the two are spaced apart a distance equal to that between the main beams 14 and 15. In addition, hole 40 is formed in each flange 39 and the holes of each pair are spaced apart a distance equal to that between the openings 32 in the main beams 14 and 15. In this manner, the support members 34 may be affixed to the main beams 14 and 15 by bolts 40 at a plurality of discreet locations defined by the location of the holes 32. The web portion 36 of each transverse member 34 also has two rows of spaced apart apertures 42 extending therealong in a parallel, spaced apart relation to permit attachment to the support assemblies 22 thereon. This provides the primary transverse reference locations for the system.

Each support assembly 22 includes a base 46 which may be fixedly mounted on member 34 and a support 48 which is adjustable three dimensionally relative to the fixed base 46. In particular, the member 48 is treadably coupled to a body member 50 for vertical adjustment while the body member 50 is mounted on base 46 for longitudinal and transverse movement by a slide assembly 52. In this manner each support 46 can be accurately positioned so as to define the location of a vehicle reference datum point.

The support 48 includes a threaded shank portion 53 and a reduced diameter upper end portion 54 so as to define a shoulder 55 therebetween. A larger diameter ring 56 rests on shoulder 55 and is retained thereon by a roll pin 57 which extends through aligned holes formed through ring 56 and end portion 54. A cup-shaped housing 58 has a central bottom opening 59 which is V-shaped in vertical section and is received over the upper end portion 54 of support 48. The lower surface of housing 58 is retained against ring 56 by balls 60 which are disposed in transverse hole 61 in end portion 54 and is urged by spring 62 into engagement with the groved opening 59. Once positioned the upper annular rim 63 of housing 58 defines the proper location of a vehicle datum point relative to the plane defined by the surfaces of the main beam flanges 30. Disposed within housing 58 is a locating member 64 having a conical upper end 65 and a tubular body portion 66 which is telescopingly received within housing 58. A spring 68 is disposed between the base of housing 58 and member 64 for biasing the latter upwardly and against a stop formed by a ring 69 adjacent the open upper end of housing 58.

The slide assembly 52 includes a rectangular body 70 having a threaded central aperture for receiving the threaded shank 53 in support 48. Fixed in spaced apart relation beneath body 70 by screws 72 are a pair of bearings 74 and these are mounted respectively on slide rods 76 which are, in turn, supported in parallel spaced apart relation and form a part of the slide assembly 52. The slide assembly also includes a second pair of parallel spaced apart slide rods 78 supported on base 46 in a perpendicular relation to rods 76. More specifically, at each corner of base 46 there is a vertical post 80 having a cylindrical opening 81 which is aligned with a corresponding opening in a post at the opposite end of the base 46 for receiving one end of a slide rod 78 which is retained therein by a set screw 83. Mounted on each rod 78 is a slide 85 having a bearing 86 for slideably engaging its associated rod. Each slide also includes a pair of spaced apart holes 88, each of which receives one of the slide rods 76. These too are retained in the apertures by set screws 90. In this manner, the body 70 and the support member 48 carried thereby are movable on rods 76 in a direction parallel to the members 34 while the member 48 along with the body 70, the guide rods 76 and slides 85 are movable on rods 78 in a direction normal to member 34. As a result, fine adjustment of the support members 48 is provided in addition to the gross adjustment thereof provided by the holes 42 in members 34 and the holes 32 in members 30. Each of the rods 78 has a flat area 92 on its outer surface and the rod 76 has a similar flat area 94. Set screws 96 on slide 85 and 98 on bearing 74 which are engageable with the flats 92 and 94, respectively, are provided for holding the member 70 in its adjusted position.

First and second scales 100 and 102 are respectively fixed to one of a pair of intersecting sides of the support 22 with one being parallel to each of the slides 76 and 78. In addition, indicators 103 and 104 are respectively fixed to body 70 and slide 85 and extend over the fronts of scales 100 and 102. This permits the precise location of support 48 relative to the base 46.

Figure 6:
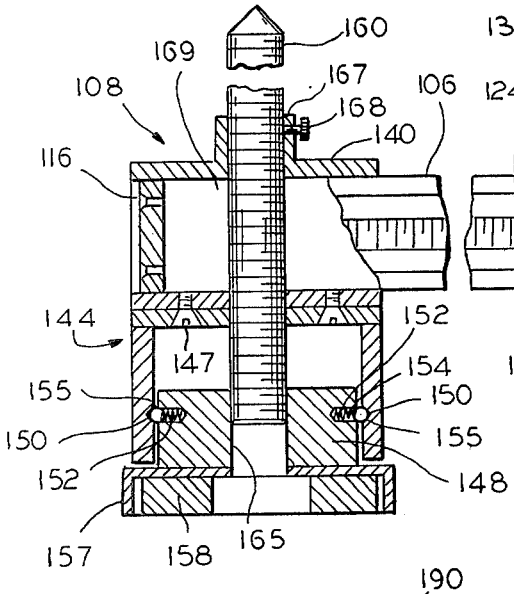
FIG. 6 shows one of the gauges which forms part of the measuring bridge shown in FIG. 1.
Figure 6:
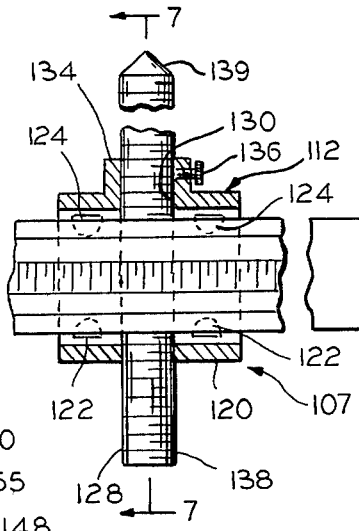
Figure 10:
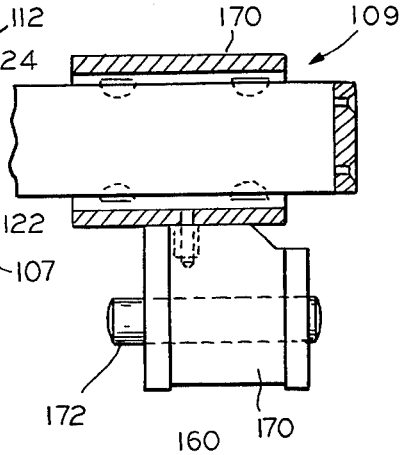
FIG. 10 is a view taken along lines 10—10 of FIG. 9.
Figure 10:
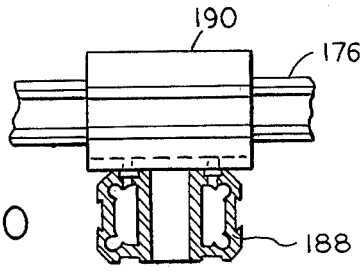
Figure 8:
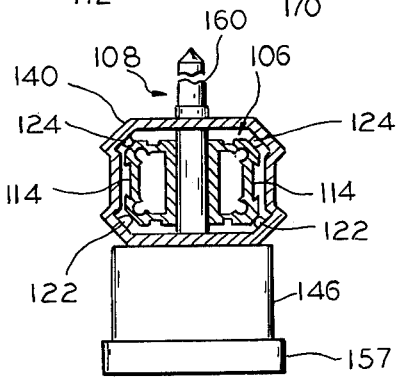
FIG. 8 is an end view of the gauges illustrated in FIG. 6.
Figure 9:
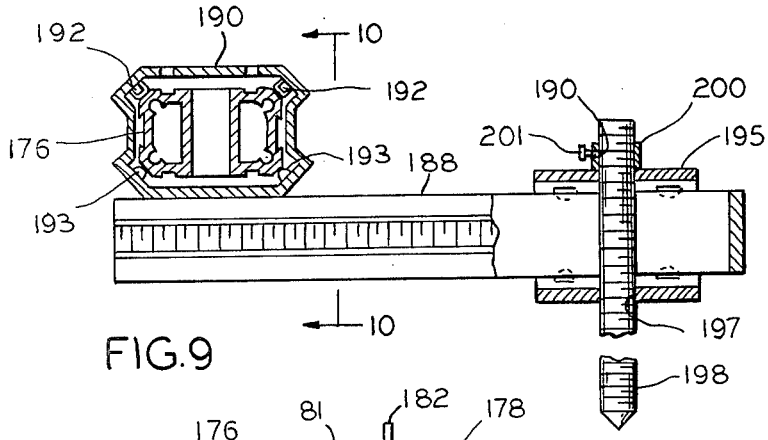
FIG. 9 is a side elevational view, with parts broken away, of another one of the gauges which forms a part of the measuring bridge in FIG. 1.
Figure 7:
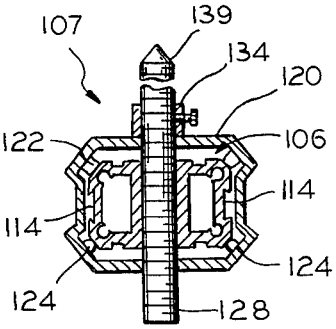
FIG. 7 is a view taken along lines 7—7 of FIG. 6.
Figure 11:
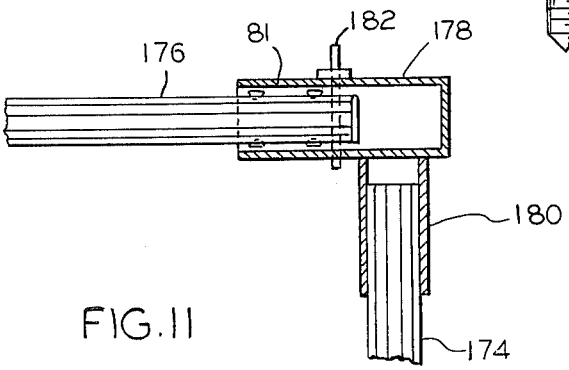
FIG. 11 shows a portion of the support for the guage illustrated in FIG. 9.

Reference is now made to FIGS. 1, 6, 7 and 8 which show the portable guage 24 to include an elongate beam 106 having an indicating device 107 slideably mounted thereon and a pair of end supports 108 and 109. The beam 106 is shown in FIGS. 6, 7 and 8 to comprise a pair of elongate members 114 which are generally D-shaped in transverse cross-section and are held in a back-to-back, spaced apart relation, by end plates 116 to which they are suitably secured.

The indicating device 112 includes a carrier member 120 shown in FIG. 7 to be hollow and to have an internal configuration similar to the outer configuration of the beam 106 and spaced therefrom. In addition, generally U-shaped spring members 122 are affixed to the internal surface of carrier 120 at each of its lower corners and at its opposite ends for resiliently engaging corresponding outer surfaces on the beam members 114. There are also pairs of nylon buttons 124 affixed to the internal surface of carrier 120 along its upper margin.

This permits the carrier 107 to slide along beam 106 and to be resiliently held in position when set. The beam 106 may also have indicia 126 provided thereon so that the position of the indicating device 107 thereon can be accurately and quickly determined.

Indicating device 112 also includes an elongate rod-like indicating member 128 which extends between beam members 114 and is through aligned openings 130 and 131 formed in the upper and lower portions of carrier 120. There is also a collar 134 affixed to carrier 120 about opening 130 for stabilizing the indicating element. A set screw 136 extending through collar 134 so that the indicating member 128 may be fixed in a predetermined vertical position relative to beam 106 and carrier 120. Indicia 138 may be formed on the outer surface of indicating member 128 so its vertical position can be readily determined. In addition the upper end 139 of member 128 may be conical for being received within a datum aperture on the lower portion of the vehicle.

The support 108 includes a sleeve member 140 which telescopingly engages the end of beam 106. As seen in FIG. 8, the inner surface of sleeve member 140 and the mating outer surface of beam 106 are complimentary. A base assembly 144 is disposed below sleeve 140 and includes an inverted, cup-shaped housing 146 which is secured by screws 147 to the underside of sleeve member 140. An annular body 148 is disposed adjacent the lower end of housing 146 and has a plurality of balls 150 disposed in recesses 152 arranged around its periphery and urged by springs 154 into engagement with an annular groove 155 formed around the inner periphery of housing 146. Affixed to the lower end of body 148 is an inverted shallow dished member 147 and to which an annular magnet 158 is secured. It will be appreciated that the body 148 and the magnet 158 are rotatably mounted by means of balls 150 and groove 155 relative to the remainder of the base assembly 144 and the beam 106.

An indicating member 160 which is identical to element 128 extends through aligned openings 162, 163 and 164 in the upper and lower portions of the sleeve 140 and the housing 146 respectively and into the hollow interior 165 of body 148. Member 160 may be fixed in a desired vertical position by means of the collar 167 affixed to member 140 in surrounding relation to opening 162 and a set screw 168.

The support 109 at the opposite end of the indicator 28 comprises a sleeve 170 for slideably engaging the bar 106 and a magnet 170 fixed to the bottom. Magnet 170 is of the type wherein the magnetic effects can be blocked and unblocked by alternately depressing a push button 172 extending therefrom. One such magnet is part No. 1657 P manufactured by L. S. Starret Co. of Athal, Mass. The sleeve 170 is similar in its outer configuration to the carrier member 120 of indicating device 112 and springs 122 and nylon buttons 124 for slideably retaining the assembly 109 on the beam 106.

The overhead guage assembly 126 is shown in FIGS. 1, 9, 10 and 11 to include a support frame consisting of vertical beams 174 and 175, top beam 176 and base beam 177. The beams 174, 175 and 176 are identical to beam 106 that consists of a pair of members joined at their ends. In fact, beams 106 and 176 are preferably interchangeable so that a single beam may be employed for guages 24 and 26. Accordingly, the beams 175, 176 and 177 will not be discussed in further detail for the sake of brevity. The upper ends of beams 174 and 175 are joined to beam 176 by end fittings 178 which are shown more particularly in FIG. 11 and the lower ends of beams 174 and 175 are received in sockets 179, respectively, which are affixed to base beam 177. The relative cross-sectional configurations of the beams 174, 175 and 176, the end fittings 178, and sockets 179 are preferably identical to that of the beam 106 and the sleeve 173 shown in FIG. 6. In particular, end fittings 178 have first and second tubular, open ended portions 180 and 181 which are affixed at right angles to each other for being slideably received over the ends of beams 174 and 176, respectively. Pins 182 may be employed for retaining the beam 176 in tubular portion 181 in the same manner discussed with respect to pin 174 and beam 106. The sockets 179 are also tubular, open ended members which are secured to and fact upwardly from base beam 177. The beams 174 and 175 may be secured in the tubular portions 180 of end fittings 178 and the sockets 179 in any suitable manner such as by set screws (not shown).

The base beam 177 may be rectangular in vertical section and has a pair of apertured flanges 183 extending in spaced apart relation from adjacent its opposite sides and at a distance equal to that between the flanges 30 in the main beams 14 and 15. In addition, the lower wall of beam 177 may have apertures (not shown) which are aligned with and spaced from the apertures in flanges 180 a distance equal to that between apertures 32 in the main beams 14 and 15. This permits the overhead guage assembly to be affixed along with the main frame 12 at discreet locations by means of bolts 184 which extend through the openings in each of the flanges and the underside of beam 177.

Referring again to FIG. 1, a pair of identical overhead measuring guages 186 are mounted for sliding movement along beam 176. Guages 186 are shown more particularly in FIGS. 9 and 10 to include a short beam section 188 which is identical in cross-sectional configuration to the beam 170. A sleeve 190 is affixed transversely adjacent one end of the beam section 188 for being received over beam 176. It can be seen in FIG. 9 that the cross-sectional configuration of sleeve 190 is similar to but larger than the beam 176 so that a gap exists therebetween. However, sleeve 190 is retained snugly on beam 176 by means of a plurality of spring members 192 mounted at the lower corners of sleeve 190 and a plurality of bearing members 193, such as nylon buttons, which are disposed along the four upper corners thereof. This permits the guage 186 to slide along the beam 176 but at the same time being retained in its various preset positions.

A second sleeve 195, which is identical to sleeve 190, is slideably received on beam 188 and has a pair of aligned apertures 196 and 197 in its upper and lower surfaces through which an indicating element 198 extends. A collar 200 and set screw 201 permit the element 198 to be adjusted vertically relative thereto. The beams 174, 175 and 176, beam section 188, and the element 198 will all have indicia provided thereon so that the position of the lower end of element 198 can be actively determined relative to the support assemblies 22.

In operation, the relative locations of four critical datum points such as bolt holes on the underside of the vehicle to be repaired are first determined from the manufacturer's specifications. The four support assemblies 22 are then positioned and attached to the main frame 12 so that the data points should normally fall within the margin of the respective slide assemblies 52.

Next, the measuring members 48 are positioned horizontally and vertically using the first and second scales 100 and 102 on the support 22 and the scale 105 on the shank 53 of support 48 so that the upper rim of their respective housings 58 are co-axial with and at the same elevation relative to the plane defined by the surface of the main beam flanges 30 as the vehicle datum points by which the vehicle is to be supported and positioned.

The vehilce to be repaired is then elevated by a hoist or jacks and the measuring bridge 10 is rolled under the elevated vehicle and properly positioned. The vehicle is then lowered so that each of its data points will first engage the member 64 of each support 48 which is then depressed until the vehicle data point comes to rest on the upper rim 63 of housing 48. The vehicle is thus supported on four spaced-apart data points on its underbody. In the event any such data point is out of alignment as a result of damage, the vehicle can then be reformed until the four support data points are in their proper relative positions. With the vehicle thus positioned, the relative position of all other datum points on the vehicle should have a predetermined position relative to the reference plane, which in this case is that defined by the upper surfaces of flanges 30. Any deviation of a reference point from its correct position is the basis for the vehicle repair. While four support assemblies 22 are provided for stability, it will be appreciated that a correct reference plan can be established by three support points.

Once the vehicle has been positioned on supports 48, it may be clamped in position so that it will not move relative to the bridge 10 when the body repair commences. For this purpose, a plurality of clamps 210 are affixed to the main frame 12. Each clamp may be suitably attached to the frame such as by means of a pair of bars 212 which are affixed transversely by means of brackets 214. It will be appreciated that one clamp 210 will be mounted at each end of the bars 214 and each clamp 210 may be of the type which is constructed and arranged to grip the pinch weld seam on the underside of a uni-body type vehicle, for example. The details of the clamp 210 form no part of the invention and accordingly will not be discussed and detailed for the sake of brevity.

After the vehicle has been clamped to the main frame 12, the portable guage 24 and/or the overhead guage may be positioned. As indicated previously, the specifications provided by vehicle manufacturers are generally in the form of charts showing the distances from a few critical underbody datum points to other datum points beneath the vehicle. Two such datum points are commonly located beneath and toward one side of the vehicle. The guage 24 is therefore positioned with the indicating element 160 of end support 108 co-axially with and beneath one such critical data point. The element 160 is then raised into engagement with the data points so that the elevation thereof above the frame 12 can be confirmed. The attraction between magnet 108 and the ferrous metal of the main frame 12 firmly holds the end assembly 108 in the position just located. The magnet 171 of end assembly 109 however is turned off. The guage 24 can thus be pivoted about the axis of measuring element 160 until the beam 106 is in the correct angular position relative to another datum point beneath the vehicle. The button 172 of magnet 171 is then depressed whereby the magnet becomes coupled to the main frame 12 so that the opposite ends of the guage are magnetically fixed. Next the indicating device 197 is then slid along the beam 106 until it is at a position therealong corresponding to the distance between the datum points as indicated in the manufacturer's specifications. The indicating member 128 should then be in alignment with the datum point if that portion of the vehicle is undamaged. Assuming such alignment is confirmed, the measuring element 128 is elevated to also confirm that the elevation of the data point being considered is proper with respect to the base datum point. If the datum point being considered is out of alignment with element 128 or is not at the proper elevation, the vehicle can then be reformed until proper positioning is achieved. In a similar manner, the relative position of other datum points on one side of the vehicle can be determined. The guage 24 can then be positioned beneath base datum points at the opposite side of the vehicle and similar measurements made. It will be appreciated that because one end of the guage 24 is magnetically fixed in a predetermined location beneath the vehicle once positioned, all such measurements with guage 24 can be made by a single operator.

For the location of data points in the upper portion of the vehicle, the beam 177 is first attached to the main frame 12 at a position adjacent the points to be measured. The measuring guages 186 may then slide along beam 176 until they are in the desired lateral position. Next the sleeves 195 are moved along beams 188 until the measuring elements 198 are in vertical alignment above the proper location for the data point being located. The element 198 is then lowered to the indicated vertical elevation. This will then determine the degree of reformation, if any, required to move the upper datum points into proper alignment.

While both beams 106 and 176 are shown in FIG. 1, it will be appreciated that these members may be identical. For this reason, a single beam can first be used for guage 24 after the measurements are made beneath the vehicle, the measuring element 160 and the pin 147 may be withdrawn and the beam 106 removed from the end assemblies 108 and 109. The guage 112 may then be removed after which the guage assemblies 186 slide into position. The ends of the beam may then slide into the end fittings 178 and the pins 182 inserted into position. Finally, the end fittings 178 may be lowered onto the vertical beams 174 and 175. The upper gauge assembly is then ready to perform the desired measurements.

The measuring assembly just described can provide a rapid and accurate determination of vehicle damage by a single operator. In addition, measurements can be determined directly from manufacturer's specifications and a different set of fixtures is not required for each vehicle model.

While only a single embodiment of the present invention has been illustrated and described, it is not intended to be limited thereby but only by the scope of the appended claims we claim.

1. A measuring bridge including a main frame, means on said main frame defining a reference plane and a plurality of reference points in said plane, a plurality of support assemblies for supporting a vehicle in a fixed orientation relative to said reference plane and the reference points, coupling means for securing each support assembly in a discrete location relative to said reference plane and spaced a predetermined distance from each of the other said support assemblies and from the reference points, each support assembly including base means releasably securable to said main frame by said coupling means, a support element and adjustment means for mounting said support element on said base means, each said adjustment means being constructed and arranged for displacing said support elements three dimensionally relative to said base means whereby said support elements can be arranged in a predetermined array relative to said reference plane, each of said adjustment means including three dimensional indicating means so that the position of each support element relative to the reference plane and the reference points can be determined, each said support element being adapted to be engaged by a datum point on the underside of a vehicle for supporting said vehicle in a predetermined orientation relative to said reference plane and for indicating misalignment of any such datum point, and gauge means mounted on said frame in a predetermined orientation relative to said reference plane and the reference points for determining the relative position of other datum points on damaged portions of said vehicle relative to said reference plane and said reference points.

2. The measuring bridge set forth in claim 1 wherein said adjustment means includes first means for moving said support element bidirectionally in a plane parallel to said reference plane and second means for moving the same perpendicularly to said reference plane, said indicating means being mounted on said first and second means.

3. The measuring bridge set forth in claim 1 wherein each said adjustment means includes first slide means for adjusting said support elements in a first direction parallel to said reference plane, second slide means for adjusting said support elements in a second direction parallel to said reference plane and normal to said first direction, said support element being threadably engageable with said adjustment means for moving the same vertically relative thereto.

4. The measuring bridge set forth in claims 2 or 3 wherein said support elements each include an annular reference surface at the upper end thereof for surroundingly engaging the vehicle datum point.

5. The measuring bridge set forth in claim 4 wherein the support element includes hollow housing means at its upper end and has an upper opening which defines said annular surface, and a locating member disposed within said housing means and having an indicator extending through said opening, and spring means within said housing for biasing the locating member outwardly thereof.

6. The measuring bridge set forth in claim 3 wherein said support elements each include an annular reference surface at the upper end thereof for surroundingly engaging the vehicle datum point.

7. The measuring bridge set forth in claim 6 wherein said main frame comprises a pair of main beam members each having an upper surface coplanar with the other surface which define said reference plane, a row of apertures formed in each said surfaces to define said reference points, said rows of apertures being parallel, said coupling means being engageable with at least one of said holes in each row for locating said support assemblies.

8. The measuring bridge set forth in claim 7 wherein said coupling means comprises a second pair of beam members extending transversely to said main beam members and each being secured to an opening in each row, at least one row of apertures formed in each of said second beam members, said coupling means including means for securing a pair of support assemblies on each beam of said second pair and to spaced apart apertures thereon.

9. The measuring bridge set forth in claims 1 or 2 wherein said main frame comprises a pair of main beam members each having an upper surface, said surfaces being coplanar to define said reference plane, a row of apertures formed in each said surface to define said reference points, said rows of apertures being parallel, said coupling means being engageable with at least one of said holes in each row for locating said support assemblies.

10. The measuring bridge set forth in claim 9 wherein said coupling means comprises a second pair of beam members extending transversely to said main beam members and each being secured to an opening in each row, at least one row of apertures formed in each of said second beam members, said coupling means including means for securing a pair of support assemblies on each beam of said second pair and to spaced apart apertures therein.

11. The measuring bridge set forth in claim 1 wherein said gauge means including elongate bar means, means for securing said bar means on said main frame in a predetermined position relative to said vehicle, a measuring device slideably mounted on said bar means and having a measuring element mounted thereon, means for supporting said measuring element in adjustable positions normal relative to said bar means.

12. The measuring bridge set forth in claim 11 wherein said measuring device comprises a second bar means extending laterally from said elongate bar means and slideably coupled thereto, said measuring element being slideably mounted on said second bar means and being perpendicularly adjustable relative thereto.

13. The measuring bridge set forth in claim 11 and including magnetic coupling means mounted adjacent one end of said elongate bar means, said main frame being of a ferrous material whereby said magnetic coupling means is attachable magnetically to said frame means, said bar means being pivotally connected to said magnetic coupling means whereby said bar means may pivot in a horizontal plane about an axis passing through said magnetic coupling means.

14. The measuring bridge set forth in claim 13 and including a second magnetic coupling means disposed adjacent the opposite end of said bar means, said second magnetic coupling means being constructed and arranged for selective magnetic coupling to said frame means, said measuring device being mounted on said elongate bar means between said magnetic coupling means.

15. The measuring bridge set forth in claim 14 wherein said adjustment means includes means for moving said support element bidirectionally in a horizontal plane and for moving the same vertically.

16. The measuring bridge set forth in claim 15 and including first slide means for adjusting said support element in the first horizontal direction, second slide means for adjusting said support element in a second horizontal direction normal to said first horizontal direction, said support element being threadably engageable with said adjustment means for moving the same vertically relative thereto.

17. The measuring bridge set forth in claim 16 wherein said elongate bar means includes a pair of elongate members, means disposed at the opposite ends of said elongate members for retaining the same in a parallel spaced-apart relation, said measuring device including a sleeve surrounding said elongate bar means and an elongate measuring element extending through said sleeve and the space between said members so that said sleeve may move longitudinally of said bar means.

18. The measuring bridge set forth in claim 1 wherein said adjustment means includes first means for moving said support means bidirectionally in a plane parallel to said reference plane and second means for moving the same perpendicular to said plane.

19. The measuring bridge set forth in claim 18 wherein said first means includes a first slide for adjusting said support means in the first direction parallel to said reference plane and a second slide for adjusting said support means in a second direction parallel to said plane and normal to said first direction, said support means being threadably engageable with said adjustment device for moving the same perpendicular to said reference plane.

20. The measuring bridge set forth in claim 18 wherein said gauge means including elongate bar means, means for securing said bar means on said main frame in a predetermined position relative to said vehicle, a measuring device slideably mounted on said bar means and having a measuring element mounted thereon, means for supporting said measuring element in adjustable positions perpendicular to said arm means.

21. The measuring bridge set forth in claim 20 wherein said measuring device comprises a second bar means extending laterally from said elongate bar means and slideably coupled thereto, said measuring element being slideably mounted on said second bar means and being perpendicularly adjustable relative thereto, and indicating means on said first and second bar means and on said element whereby the position in space of said element relative to said reference point and said reference plane can be accurately determined.

22. A portable measuring assembly including elongate bar means, a magnetic coupler mounted adjacent one end of said elongate bar means, said bar means being pivotally connected to said magnetic coupler whereby said bar means may pivot in a horizontal plane about an axis passing through said magnetic coupler, a measuring device slideably mounted on said bar means and having a first elongate measuring element mounted thereon, means for supporting said first elongate measuring element for movement in a direction normal to said bar means, and a second elongate measuring element mounted coaxically with the pivot axis of said magnetic coupler, said second measuring element being movable in said normal direction and extending in a direction parallel to the first elongate measuring element on said measuring device.

23. The measuring assembly set forth in claims 22 or 20 wherein said elongate bar means includes a pair of elongate members, means disposed at the opposite ends of said elongate members for retaining the same in a parallel spaced-apart relation, said measuring device including a sleeve surrounding said elongate bar means and an elongate measuring element extending through said sleeve and the space between said members so that said sleeve may move longitudinally of said bar means.

24. The measuring assembly set forth in claim 23 wherein said magnetic coupler and said magnetic coupling means each includes a sleeve received over the end of said bar means, and a retaining means extending through said bar means and each of said sleeves respectively for retaining said bar means within said sleeves, a second measuring element comprising the retaining means for said magnetic coupler.

25. A measuring bridge for supporting a vehicle in a predetermined orientation relative to a reference plane and reference points and for determining the deviation of datum points on said vehicle relative to said reference plane, said measuring bridge including a main frame, means on said main frame for defining said reference plane, at least three support assemblies, coupling means for securing each support assembly in a selected one of a plurality of discrete locations on said main frame which defines said reference points and relative to said reference plane and spaced a predetermined distance from each of the other said support assemblies, each support assembly including base means releasably securable to said main frame by said first coupling means, support means, adjustment means for mounting said support means on said base means, said adjustment means being constructed and arranged to permit adjustment of said support means bi-directionally in a plane parallel to said reference plane and in a third direction normal to said plane, each of said adjustment means including indicating means for indicating three dimensionally the position of said support relative to said reference plane and said reference points, said supports including means adapted to be engaged by datum points on the underside of a vehicle for supporting said vehicle on said frame in said predetermined orientation relative to said reference point and said reference plane, and for indicating misalignment of any of said datum points, and gauge means releasably mountable on said frame for determining the relative position of datum points on damaged portions of said vehicle relative to a reference datum point.

26. A portable measuring assembly including elongate bar means, a magnetic coupler mounted adjacent one end of said elongate bar means, said bar means being pivotally connected to said magnetic coupler whereby said bar means may pivot in magnetic coupling means, a measuring device slideably mounted on said bar means and having an elongate measuring element mounted thereon, means for supporting said measuring element for movement in a direction normal to bar arm means, and a magnetic coupling means disposed adjacent the opposite end of said bar means, said magnetic coupling means being constructed and arranged for selective magnetic coupling, said measuring device being mounted on said elongate bar means between said magnetic coupling means and said magnetic coupler.

* * * * *